United States Patent [19]

Sussman

[11] 4,121,722

[45] Oct. 24, 1978

[54] UNIT COUNTER FOR PILLS, TABLETS, SPHERES, COINS AND THE LIKE

[76] Inventor: Meyer Sussman, 190 Beach 149th St., Rockaway Park, N.Y. 11694

[21] Appl. No.: 748,102

[22] Filed: Dec. 6, 1976

[51] Int. Cl.[2] ..... B65B 67/02

[52] U.S. Cl. ..... 214/1 C; 133/8 R

[58] Field of Search ..... 214/1 C; 206/0.8–0.84, 206/459, 557; 133/8 A, 8 R, 8 C, 1 A; 116/121

[56] References Cited

U.S. PATENT DOCUMENTS

| | | | |
|---|---|---|---|
| 2,530,009 | 11/1950 | Fields | 133/8 R X |
| 2,952,369 | 9/1960 | Rew | 214/1 C |

FOREIGN PATENT DOCUMENTS

| | | | |
|---|---|---|---|
| 203,449 | 10/1908 | Fed. Rep. of Germany | 133/8 R |
| 1,263,927 | 2/1972 | United Kingdom | 214/1 C |

*Primary Examiner*—Stanley H. Tollberg
*Assistant Examiner*—Francis J. Bartuska
*Attorney, Agent, or Firm*—Friedman, Goodman & Teitelbaum

[57] ABSTRACT

An improved unit counter, which includes a bottom tray having two adjoining upstanding sides secured thereto, provides an included angle of 60° to define a first corner in which a plurality of generally rounded pills or the like may be nested in such a manner to form an equilateral triangle of pills. A third upstanding side is secured to the bottom and adjoins one of the first two sides to provide an included angle of 90° defining a second corner in which a plurality of generally oblong capsules or the like may be nested. A fourth upstanding side is secured to the bottom and adjoins the third side and converges towards the first side but remains spaced apart to provide an opening through which the pills or capsules contained within the tray may be poured therefrom. A storage area is included to retain the surplus of pills or capsules over and above a desired amount counted. A scale is disposed on the bottom of the tray including associated pairs of integers to determine a desired number of pills that are included in the triangle. A slide is provided for indicating a predetermined amount of pills to be counted.

11 Claims, 4 Drawing Figures

UNIT COUNTER FOR PILLS, TABLETS, SPHERES, COINS AND THE LIKE

BACKGROUND OF THE INVENTION

This invention relates generally to unit counters and more particularly to an improved unit counter capable of counting either pills, capsules or the like, and storing excessive pills or capsules above a desired count.

It is a well known mathematical principle that the area of an equilateral triangle is related to the length of one of its sides. Based upon this relationship, there is provided in the prior art a pill counter as is described in U.S. Pat. No. 2,952,369. The pill counter described includes a bottom tray with upstanding sides interconnected to form a 60° angle therebetween. A triangle of pills can be nested into the corner angle. Two rows of indicia are located remote from the corner. The integers of the first row represent the number of pills in one side of the triangle of pills and the corresponding integer in the next row of indicia represents the total number of pills which are contained in the triangle. The inter-relationship between the two rows of indicia is based on the well known mathematical relationship.

While the aforementioned pill counter is useful, it has many drawbacks which have prevented it from becoming a widely accepted tool. One of the main drawbacks is that the counter is only adapted to accommodate round pills. However, in present pharmacology, oblong capsules are utilized almost as freqently as round pills and they too must be counted.

The use of the prior art pill counter is such that a plurality of pills are placed in the tray and then, based upon the number of pills along one side of a triangle, the total number of pills are counted. As described in the aforementioned patent, the pill counter can be utilized to count such total number of pills. For example, at the end of a day it is frequently necessary to count the total number of pills remaining. All of these pills may be placed in the pill counter and counted.

However, frequently rather than counting all of the pills which are available, it is necessary to count only a predetermined number of pills, as for example when filling a prescription. In such use, a large number of pills are placed in the pill counter and only a small number of those are to be placed in a bottle to fill a prescription. The remaining pills must be restored. Using the pill counter of the aforementioned patent, it is not possible to easily separate a desired number of pills from a total amount of available pills.

An additional problem with the prior art pill counter is that the relationship between the total number of pills in the triangle and the number along one side does not provide the usually desired or conventional numbers for counting. For example, the relationship is such as to give very unusual numbers in a total triangle of pills, such as 21, 28, 66, 78, 91, etc. While these numbers may be convenient for counting the total number of pills, when trying to fill a prescription, it is generally required to provide an even amount of pills, generally in multiples of tens and hundreds. Using the pill counter of the prior art it is most difficult to obtain a pill count in multiples of ten, and, even if such were obtained, it becomes difficult to separate the surplus from the desired count.

SUMMARY OF THE INVENTION

It is therefore an object of the present invention to provide a unit counter which avoids the aforementioned problems of prior art devices.

Yet a further object of the present invention is to provide a unit counter which can accommodate the counting of either round pills and the like or oblong capsules and the like.

Yet another object of the present invention is to provide a unit counter which can be used to count a desired number of pills, capsules or the like, while the surplus over the desired number can be stored; the desired number being easily poured out from the tray without any of the stored remainder.

A further object of the present invention is to provide a unit counter which includes a storage area and which is formed of a single piece construction.

Yet another object of the present invention is to provide a unit counter with an improved scale which provides an indication of the number of units in a triangle of units such that the count can be of simple numbers and especially in multiples of tens and other such convenient numbers.

A further object of the present invention is to provide a unit counter with an improved scale including integers which are positioned with respect to sector lines of the tray, whereupon when a unit corresponds in number and position to the integer, the total number of units in a triangle of units can be easily known.

Yet another object of the present invention is to provide a unit counter including a slide which can indicate a predetermined desired amount of units to be counted.

Briefly, the invention describes a unit counter comprising a polygonal tray having a bottom and two adjoining upstanding sides forming an included angle of 60° to define a first corner. A plurality of generally round shaped units may be nested into the first corner to form an equilateral triangle of units. An additional upstanding side extends in a direction from one of said two sides and converges towards but terminates a spaced distance from the other of said two sides forming an opening therebetween through which units contained within said tray may be poured therefrom.

A feature of the invention is that a further upstanding side is secured to the bottom and joins between said additional side and said one of said two sides forming an included angle of 90° with said latter mentioned side, and defining a second corner in which a plurality of generally oblonged shaped units may be nested.

Another feature of the invention is that a storage means is positioned adjacent to the additional side for storing the surplus of units which exceeds a desired count.

A third feature of the invention includes a scale means formed on the tray and positioned to lie directly under the nested round units. The scale includes pairs of integers successively lying in consecutive rows transversely to a center line bisecting the 60° angle. The first integer of each pair is positioned at a predetermined location with respect to the tray. When the number of units in the uppermost row of the triangle of units corresponds in number and position to the first integer of a pair, then the second integer of that pair represents the total number of units contained in the triangle.

Another feature of the invention is a slide means adapted to slide along one of the two sides and including a presettable indicator identifying a desired level or amount of rows of units to be nested in the first corner.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiments in which.

In the various figures of the drawing like reference characters designate like parts.

DESCRIPTION OF THE PREFERRED EMBODIMENT

Figure 1:
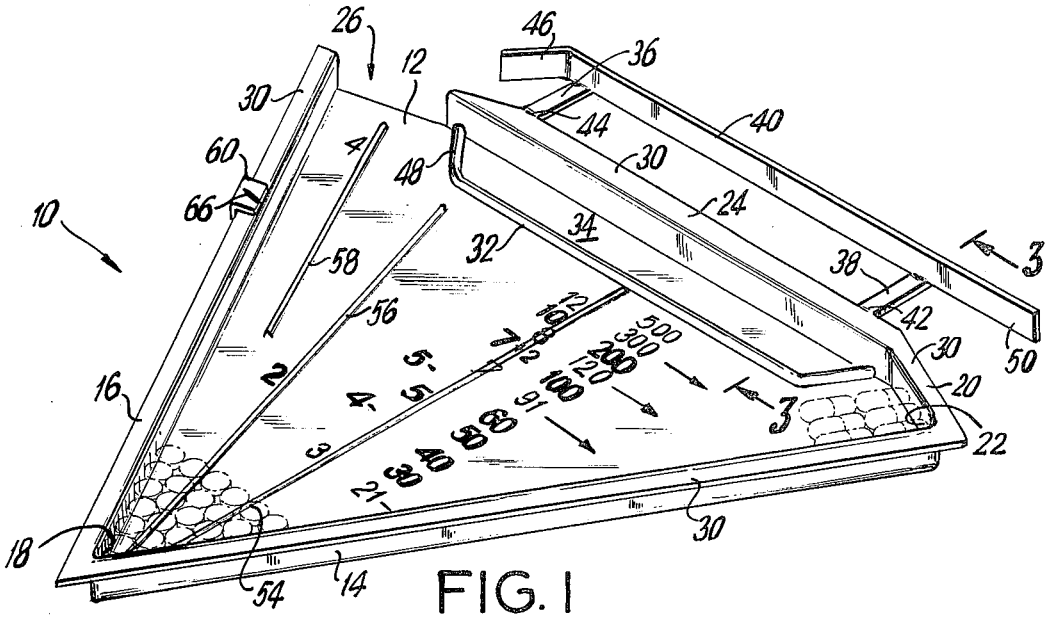
FIG. 1 represents an isometric view of the unit counter in accordance with the present invention, and showing at least part of the storage area in an open position.

Referring now to the drawings, the unit counter generally shown at 10 includes a tray 12 which has basicly a flat bottom and includes upstanding sides 14 and 16 secured to the bottom and adjoining each other to form a first corner 18 having an included angle of 60°. The first corner can accommodate a plurality of rounded units, such as pills, tablets, spheres, coins and the like, to form an equilateral triangle of units. A third upstanding side 20 adjoins the side 14 and forms an included angle of 90° to define a second corner 22. The second corner can accommodate and align a plurality of oblong units, such as capsules. A fourth upstanding side 24 adjoins the third side 20 and converges towards the first side 16 but terminates at a space distanced from the side 16 to provide an opening 26 thereby forming a spout from which pills, capsules and the like can be poured from the bottom of the tray.

Each of the sides are secured to the tray and each includes an outwardly extending flanged surface 30 at the upper part thereof.

Figure 2:
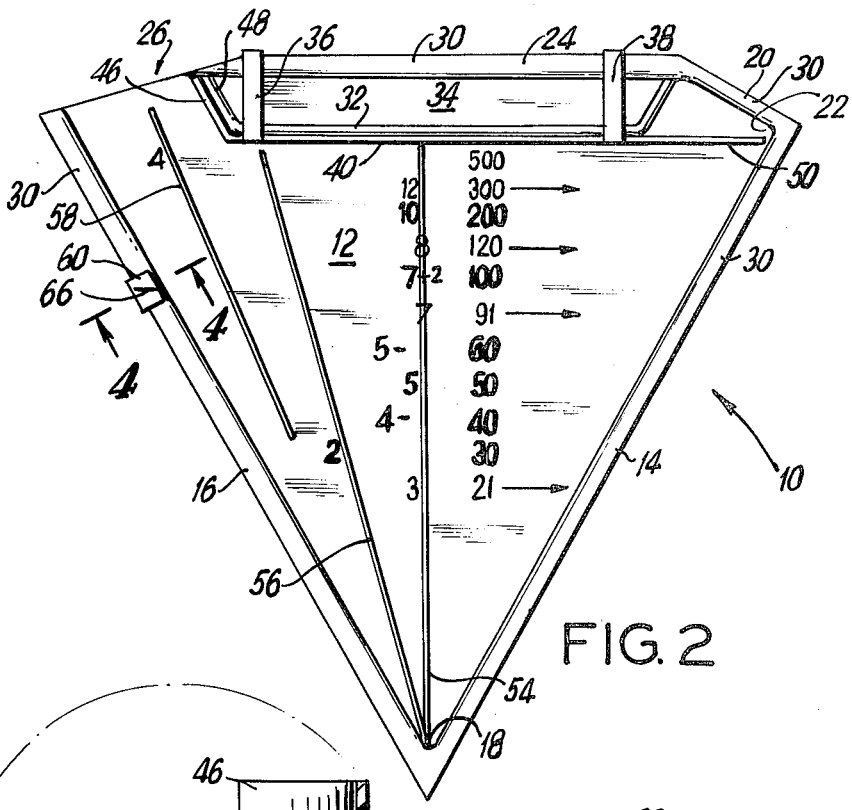
FIG. 2 shows a plan view of the unit counter, and showing a part of the storage area in a closed position.
Figure 3:
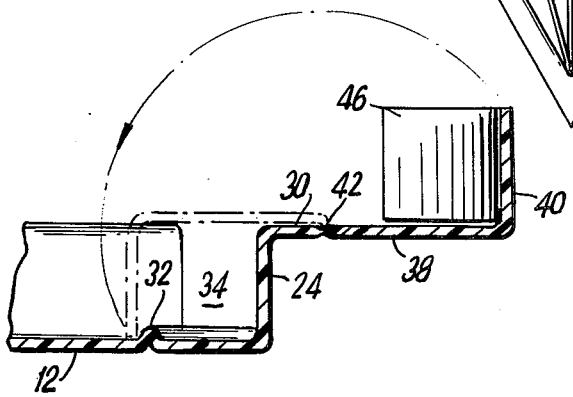
FIG. 3 represents a fragmentary sectional view taken along line 3—3 of FIG. 1 and specifically showing the storage area.

Positioned adjacent the side 24 is a storage area which is shown to include a U-shaped ridge 32 protruding from the bottom of the tray and providing an enclosed area 34. Additionally, extending from the flange 30 on the side 24 are arms 36, 38 connected to a bar 40. By scoring and thinning the interconnections 42, 44 between the arms and the flange, the bar 40 will be hingedly attached to the flange 30 and can freely swing to its open position, shown in FIGS. 1 and 3 or its closed position engaging the ridge as shown in FIG. 2, and in phantom in FIG. 3.

The storage area 34 can be used to store excess pills, capsules and the like. Placing them behind the ridged portion 32 will retain them temporarily. For more permanent retention, especially during the time when the desired pills or capsules are being poured from the tray, the bar 40 is swung over the ridge to prevent any of the pills from leaving the storage area. Typically, the height of the bar 40 will be approximately the same as the height of the sides. The bar is shown to have an end 46 that corresponds to one of the legs 48 of the ridge 32. The other end 50 of the bar 40 is shown to be straight and meets the side 14. However, that end could also be shaped to correspond to the other leg of the ridged portion.

Positioned on the bottom of the tray is a scale which includes a first raised line 54 bisecting the 60° angle, a second raised line 56 which bisects the angle formed by the line 54, and a third raised line 58 which further bisects the angle formed by the line 56. Positioned with respect to the successively bisecting raised lines are rows of indicia. The rows are transverse to the bisecting line 54 and are successively placed along consecutive lines. Each row includes a pair of integers. The first integer of each pair includes at least one number representing a number of units. The second integer of each pair indicates a total number of units in the triangle.

The first integer is positioned with respect to the tray, and more particularly with respect to one of the bisecting lines. Whereever an arrow exists, it is an indication that the entire line must be filled by units. Generally, when the number of the units in the uppermost row of the triangle of units, as counted from the side 16, equals the integer itself, and is positioned in the tray at a location similar to the location of the first integer of a pair, then the second integer gives the indication of the total number of units. The fourth side 24 is made perpendicular to the bisecting line 54 to facilitate the reading of the scale and the utilization of the unit counter.

In use, a number of units, such as round pills, are placed on the bottom of the tray. The raised lines 54, 56 and 58 cause tripping of those pills standing on end, and also aid to align the pills where those pills which are lying above other pills will slide off as the pills are moved on the tray. The desired number of pills is determined by use of the scale and the surplus is placed over the ridge in the storage area 34. The bar 40 can then be placed over the ridge to securely retain the pills in the storage area. The desired count of pills is then poured out of the opening 26 into a bottle, or other container for holding the pills. In order to easily count the number of pills, the pills are placed in the corner 18. Being a 60° angle, an equilateral triangle of round pills can be formed. Such triangle would have the same number of pills along each of its three sides.

In order to determine the desired number of pills the scale is utilized. For example, if 21 pills are desired, the third pill of the uppermost row (sixth row) should just touch the bisecting line 54, as shown by the number 3, and the entire row should be complete with pills, as shown by the arrow. In order to have 30 pills, all of the previous rows (seven rows) are to be complete with pills and the uppermost row should have 2 pills, with the second pill just reaching or touching the bisecting line 56. In order to have 40 pills, all of the rows (eight rows) should be complete, except for the uppermost row which should have 4 pills, with the fourth pill positioned at a distance of half the pill width space from the bisecting line 54. For 50 pills, the previous row (nineth row) should be complete, and the uppermost row should have its fifth pill just touching the bisecting line 54. For 60 pills, all the previous (10) rows should be complete, and the uppermost row should have its fifth pill positioned at a half pill width distance from the bisecting line 54. For 91 all of the (13) rows should be complete, including the uppermost row as shown by the arrow, with the seventh pill of the uppermost row positioned directly on the bisecting line 54. For 100 pills, the previous (13) rows should be complete, and the uppermost row should have 7 pills up to the bisecting line 54, with two additional pills passed the bisecting line 54 to the right. For 120 pills, all of the (15) rows should be complete including the uppermost row, with the eighth pill of the uppermost row positioned on the bisecting line 54. For 200 pills, the tenth pill in the uppermost (20) row should just touch the bisecting line 54. For 300 pills, the twelfth pill in the uppermost row (24) should just touch the bisecting line 54. For 500 pills, all of the previous (31) rows should be complete, and the uppermost row should have its fourth pill just before and touching the bisecting line 58.

It will be noted, that each of the numbers in the scale have been adjusted to provide useful numbers, as is frequently required by prescriptions, and especially multiples of 10 and 100. This provides a more convenient way of determining a desired count for pills required to fill prescriptions, where the number of rows do not have to be counted.

If a prescription or the like calls for oblong units, such as capsules, the capsules may be placed at the corner 22, which is a 90° angle and conveniently counted by stacking the capsules and then arranging them for an easy count. After the count, the surplus may be placed in the storage area 34 and the desired number of capsules can be poured out through the opening 26.

Figure 4:
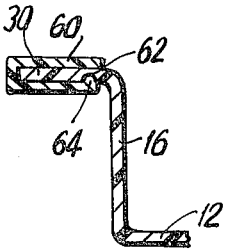
FIG. 4 is a fragmentary sectional view taken along line 4—4 and specifically showing the slide means.

Frequently, a predetermined number of pills must be utilized for a repetitive number of prescriptions or other identical counts. Rather than recounting or relocating the same number each time, a slide 60 is provided which includes an indicator line 66 across the slide 60. The slide, as can be seen in FIG. 4, includes a U-shaped member which slides along a flanged portion 30 of the side 16. In order to maintain the slide along the flange, a groove 62 is made on the under or lower side of the flange and a ridge protrusion 64 on one leg of the slide permits the slide to pass within the groove. Once a desired amount of pills or like units has been determined, the slide can be positioned adjacent the top or uppermost row of pills and the indicator 66 will provide a fixed indicator against which the pills can be restacked each time to thereby eliminate or avoid individual counting of recurring repetitive identical counts.

The entire unit counter, including the storage ridge 32 and the hinged bar 40 can be made of a one piece construction such as of durable plastic or metal, using well known manufacturing techniques. The scale can be printed directly of the bottom of the tray, or on an additional member such as cardboard or plastic which can be securely attached to the base.

By utilizing the unit counter as described, it will be noted that rounded units such as pills or oblong units such as capsules can be counted on the same counter. Furthermore, after a desired amount has been counted, the surplus can be retained with ease and the desired amount poured into a container. The scale provides numbers which are commonly occurring, and specifically multiples of 10 and 100. Furthermore, the use of the slide facilitates repetitive counting of identical counts.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A unit counter comprising a polygonal tray having a bottom and two adjoining upstanding sides secured thereto providing an included angle of 60° defining a first corner in which a plurality of generally round units may be nested, a third upstanding side secured to said bottom and adjoining one of said two sides to provide an included angle of 90° defining a second corner in which a plurality of generally oblong units may be nested, a fourth upstanding side secured to said bottom, said fourth side adjoining said third side and converging towards but terminating a spaced distance from the other of said two sides to provide an opening between said other and said fourth sides through which the round and oblong units contained within said tray may be poured therefrom;

scale means provided on said tray, said scale means extending from said first corner and being positioned to lie in an area covered by the nesting round units, said scale means including determining indicia provided on said tray, said indicia including pairs of integers with successive pairs of integers respectively lying on consecutive rows, said rows being transverse to and spaced along a line bisecting said 60° angle;

a first integer in each pair being positioned at a predetermined location with respect to the tray and representing a number of round units, the other integer indicating a total number of round units to be found in a triangle of round units nested in said first corner when a number of the round units in an uppermost row, as counted from a predetermined one of said two sides, corresponds both in number and in position, with respect to the tray, of the first integer of the pair; and said scale including lines successively bisecting the angle at said first corner into smaller angles, and the first integer of each pair being positioned with respect to said bisecting lines.

2. A unit counter as claimed in claim 1, wherein said fourth side is generally perpendicular to said line bisecting said 60° angle.

3. A unit counter comprising a polygonal tray having a bottom and two adjoining upstanding sides secured thereto providing an included angle of 60° defining a first corner in which a plurality of generally round units may be nested, a third upstanding side secured to said bottom and adjoining one of said two sides to provide an included angle of 90° defining a second corner in which a plurality of generally oblong units may be nested, a fourth upstanding side secured to said bottom, said fourth side adjoining said third side and converging towards but terminating a spaced distance from the other of said two sides to provide an opening between said other and said fourth sides through which the round and oblong units contained within said tray may be poured therefrom, slide means for sliding along one of said two sides, said slide means including a presettable indicator identifying a desired amount of row of round units nested in said first corner, said upstanding sides each including outwardly extending flanged edges, and said slide means being a U-shaped member having its legs slidably secured to the flanged edge of one of said two sides.

4. A unit counter as claimed in claim 3 and further comprising storage means positioned adjacent said fourth side for storing a surplus of round and oblong units exceeding a desired amount.

5. A unit counter comprising a polygonal tray capable of retaining a plurality of generally round units and having a bottom and at least two adjoining upstanding sides secured thereto providing an included angle of 60° defining a corner in which at least some of said round units may be nested to form a triangle of round units having a desired count, a third upstanding side secured to said bottom and extending from one of said two sides and converging towards but terminating a spaced distance from the other of said two sides to provide an opening between said other and said third sides through which round units contained in said tray may be poured therefrom, storage means positioned adjacent said third side for storing a surplus of said plurality of round units exceeding said desired amount;

scale means provided on said tray, said scale means extending from said first corner and being positioned to lie directly under the nested round units, said scale means including determining indicia provided on said tray, said indicia including pairs of integers with successive pairs of integers respectively lying on consecutive rows, said rows being transverse to and spaced along a line bisecting said 60° angle;

a first integer of each pair being positioned at a predetermined locating with respect to the tray and representing a number of round units, the other integer of each pair indicating a total number of round units to be found in a triangle of round units nested in said first corner when a number of round units in an uppermost row, as counted from a predetermined one of said two sides of the triangle of round units, corresponds both in number and in position, with respect to the tray, of the first integer of that pair; and said scale including lines successively bisecting the angle at said first corner into smaller angles, and the first integer of each pair being positioned with respect to said lines.

6. A unit counter as claimed in claim 5, wherein said storage means includes a ridge upwardly protruding from said bottom of said tray and defining an enclosed region adjacent at least said third side.

7. A unit counter as claimed in claim 5, wherein said storage means includes a bar hinged to said third side and capable of swinging onto said bottom of said tray to define an enclosed region adjacent at least said third side.

8. A unit counter as claimed in claim 7, wherein said storage means further includes a ridge upwardly protruding from said bottom of said tray and cooperating with said bar for defining said storage area.

9. A unit counter as claimed in claim 7, wherein said upstanding sides each include outwardly extending flanged edges, and wherein said bar includes arms extending from the flanged edges of said third side, and wherein a connection between said arms and said flanged edge provides a hinged connection therebetween.

10. A unit counter as claimed in claim 9, wherein said unit counter and storage means is of a one piece construction.

11. A unit counter as claimed in claim 5 and further comprising a fourth upstanding side secured to said bottom and interconnected between said second and third sides and providing an included angle with said second side of 90° defining a second corner in which a plurality of generally oblong units may be nested.

* * * * *